US005434368A

United States Patent [19]

Hoffmann

[11] Patent Number: 5,434,368

[45] Date of Patent: Jul. 18, 1995

[54] APPARATUS FOR CONTROLLING USE OF ELECTRICALLY POWERED EQUIPMENT

[76] Inventor: Keith F. Hoffmann, 20517 Amie Ave., Torrance, Calif. 90503

[21] Appl. No.: 132,279

[22] Filed: Oct. 6, 1993

[51] Int. Cl.[6] ..... H01H 9/28

[52] U.S. Cl. ..... 200/43.22

[58] Field of Search ..... 70/DIG. 30; 200/43.01, 200/43.02, 43.22, 43.09, 43.11, 293, 51.11, 43.16

[56] References Cited

U.S. PATENT DOCUMENTS

| | | | |
|---|---|---|---|
| 2,169,860 | 8/1939 | Von Hoorn | 200/43.22 |
| 2,629,029 | 2/1953 | Raphael . | |
| 3,024,337 | 3/1962 | Goudy et al. | 200/43.22 X |
| 3,096,409 | 7/1967 | Hubbell et al. | 200/43.22 |
| 3,247,337 | 4/1966 | Wiegal | 200/43.22 |
| 3,524,029 | 8/1970 | Laff . | |
| 3,774,049 | 11/1973 | Coleman . | |
| 4,063,110 | 12/1977 | Glick . | |
| 4,479,688 | 10/1984 | Jennings . | |
| 4,482,789 | 11/1984 | McVey | 200/43.02 |
| 4,623,765 | 11/1986 | Leydon | 200/43.22 |
| 4,638,129 | 1/1987 | Partus et al. | 200/43.22 |
| 4,647,735 | 3/1987 | Sicher . | |
| 5,061,199 | 10/1991 | McClead | 200/43.02 X |
| 5,193,665 | 3/1993 | Jankow . | |

FOREIGN PATENT DOCUMENTS

| | | | |
|---|---|---|---|
| 2226911 | 11/1974 | France | 200/43.22 |

*Primary Examiner*—Renee S. Luebke

[57] ABSTRACT

An apparatus for controlling use of electrically powered equipment includes an enclosure in which there is mounted an electrical connector receptacle which may be connected to a source of electrical power via its own power cable or plug blades. The enclosure is proportioned to receive the end of the electrical power cable or plug leads of one or more electrical power connectors of independently operated electrical devices. Plugging these devices into the electrical connector receptacle provides a direct, controlled connection to the power source. A locking device is provided on the exterior of the enclosure. This locking device could employ a variety of keyed and keyless lock designs. Disengaging the locking device unlocks the top enclosing lid of the enclosure to expose an electrical switch and a plurality of pins. When the electrical apparatus uses plug blades an attachment screw is also exposed to secure the electrical apparatus to the power source. The switch controls the flow of current from the power source to the independently operated electrical devices. The flow of current through the switch may be stopped with the top enclosing lid in the open or closed position. Simultaneously depressing the restraining pins allows the removal of a securable enclosure that is used to keep the electrical power connectors of independently operated electrical devices affixed to the invention. Preventing unauthorized operation as well as removal of independently operated electrical devices is obtained by maintaining the top enclosing lid in the closed position with the locking device engaged.

16 Claims, 4 Drawing Sheets

APPARATUS FOR CONTROLLING USE OF ELECTRICALLY POWERED EQUIPMENT

BACKGROUND

1. Field of Invention

This invention relates to electric switches in general and particularly to a lockable structure enclosing an electric switch.

2. Description of Prior Art

With the widespread and ever-increasing use of all types of electrical equipment, there has developed a need for an apparatus which can control the unauthorized use of this equipment. The need for this type of apparatus has developed as a result of the increasing interest in and emphasis on security and safety, as related to the operation of electrical equipment.

In the field of power tools which are used in the home and in schools, there is a need to restrict the use of these devices to authorized users and prevent use thereof by small children in the home or students who have not received the appropriate training. There is a similar need to limit the use of certain electrical equipment such as grinders, food processors, and slicers. Devices currently on the market such as outlet covers provide little safety because they can be easily figured out by curious youth.

In the home, it is often necessary to control the use of television receivers and video tape recorders by children. This need is related to a desire to limit the extent of television viewing by children and to restrict this use to programming which is considered appropriate.

In commercial offices, there is often a need to restrict the use of office copiers, typewriters, and other electrical equipment and to prevent the use of this equipment by unauthorized persons. This requirement often occurs when an office must remain open for purposes of cleaning or maintenance after the end of the normal business day when the authorized personnel are no longer present.

Another reason for the development of a means of limiting the operation of equipment to authorized users has been the widespread application of computers to every phase of commercial and industrial activity. This has resulted in a situation where an unauthorized user can, either unintentionally or intentionally as a result of malice, do a substantial amount of damage. This damage can result from both the entry into computer networks and the destruction or tampering with the equipment or data, as well as the obtaining of sensitive information stored in these files.

In addition, in laboratories where certain electrically operated sensitive test equipment is located, there is a similar need to restrict access to such equipment.

Some newer types of electrical equipment include a keylock feature in which a removable key is used to activate a switch which applies electrical power to the equipment. This feature meets the need for a means of limiting the operation of the equipment to authorized users. However, this feature is found only in relatively expensive types of equipment and relies on a key that could be easily lost or require the creation of a large number of copies to grant access to all authorized users. Retrofitting this feature on existing equipment is quite costly and in most cases extremely difficult or impossible. Thus, there is compelling need for a practical and economical means for controlling the use of electrical equipment.

Inventors have created several types of security devices to control access to electrical equipment. Their approaches to this problem are undesirable because they do not combine simplicity, ease of manufacture, and programmable, keyless operation in a single design. Simplicity of installation and operation as well as ease of manufacture are important if the manufacturer wants to sell a quality product to the widest range of users at the lowest possible price. Keyless operation is important because it removes the need to carry around a set of keys to run each piece of equipment the user requires access to and avoids the problems of searching for and eventually replacing lost keys. Lock programmability is important because it allows the user to personalize combinations to numbers that are easy to remember. It also provides the user the option to standardize combinations to a single number that can be applied to all the equipment the user operates. These characteristics help make the device more marketable to the general public and industry.

U.S. Pat. No. 2,629,029 to Raphael (1953) employs a keyless device but denies the user the ability to program the combination. This design also ignores available off-the-shelf components as well as opens the user to a potential shock should the power switch lack the proper insulation necessary to separate the switch from the lock to which it is directly connected. U.S. Pat. No. 3,774,049 to Coleman (1973), also a keyless device, focuses mainly on automobile applications. This design also relies on a pre-assigned combination and requires many custom components resulting in higher manufacturing costs.

U.S. Pat. Nos. 3,524,029 to Laff (1970), 4,063,110 to Glick (1977), 4,479,688 to Jennings (1984), 4,482,789 to McVey (1984), and 4,647,735 to Sicher (1987) require keys to engage the flow of electricity from the electrical wall outlet to the electrical connector receptacle. U.S. Pat. No. 5,061,199 to McClead (1991) requires a total of three keys to regulate its' operation, increasing the expense and complexity of implementing this electrical apparatus. This apparatus also requires electrical appliances to employ an electrical connector with holes in the blades to allow insertion of a locking rod. With this limitation, connector designs such as the pole type employed abroad are excluded from being used in this device. U.S. Pat. No. 3,247,337 to Wiegel (1963), an invention focusing on controlling the flow of electricity at the circuit breaker level, requires only a single key but does not provide a means to secure electrical appliances to a source of power. U.S. Pat. No. 3,524,029 to Laff (1970) includes a permanently fastened lid that denies the removal of the electrical connector from the device, preventing the user from removing or replacing the protected appliance. U.S. Pat. No. 5,193,665 to Jankow (1993) requires a key to engage the flow of electricity from the electrical wall outlet to the electrical appliance cord. This design additionally restricts the use of this device to a single appliance because it is directly part of the appliance cord. The last eight patents pose a potential safety risk because they lack the ability to stop the flow of electricity through the device without first inserting a key into the lock. This safety risk makes the devices undesirable for areas where children are present or where a "panic button" is required.

OBJECTS AND ADVANTAGES

Accordingly, several objects and advantages of the present invention are:

(a) to provide an electrical apparatus that allows electrical equipment to be rendered inoperative and incapable of use by unauthorized personnel;

(b) to provide an electrical apparatus which can be manufactured using a variety of lock designs;

(c) to provide an electrical apparatus which can employ a keyless operation to connect an electrically operated device to a source of power;

(d) to provide an electrical apparatus which employs a securing operation that allows only authorized users to remove electrical power connectors from its receptacles;

(e) to provide an electrical apparatus which can be easily installed on existing electrically operated devices, which could include the direct attachment to an existing wall outlet, without a need for modification of these devices in any way;

(f) to provide an electrical apparatus which can be easily operated in concert with existing electrically operated devices without any specialized knowledge of electricity or the devices being used;

(g) to provide an electrical apparatus that emphasizes safety in its design, allowing the flow of electricity to be stopped without requiring operation of the locking features of the electrical apparatus;

(h) to provide an electrical apparatus which is mainly comprised of off-the-shelf component parts which are readily available and economical to manufacture, resulting in a relatively low unit cost; and (i) to provide an electrical apparatus with a minimal part count for economy and ease of manufacture.

The foregoing and additional objects and other important advantages of the present electrical apparatus may be more fully understood from the ensuing description in conjunction with the accompanying drawings, which latter although showing but one embodiment of the electrical apparatus, are by no means intended in a restricting sense, since the apparatus may have to be altered in its adaptation for different purposes, such as the employment of the apparatus with a power cord so the apparatus can be operated by users when the apparatus is connected to wall outlets located behind large objects such as refrigerators. Many other uses are possible after performing a thorough review of the ensuing description in conjunction with the accompanying drawings.

SUMMARY OF THE INVENTION

In accordance with the present invention, there is provided an apparatus for controlling use of electrically powered equipment that allows electrically operated devices to be rendered inoperative and incapable of use by unauthorized personnel. The electrical apparatus consists of an enclosure which is proportioned to accept the electrical power connectors of one or more independently operated electrical devices. The preferred embodiment of the enclosure includes a hinged, slidable, or removable panel that can be secured. With the securable panel removed, the electrical power connectors of the independently operated electrical devices to be controlled are connected to an electrical connector receptacle located in the housing. The end of the electrical power cables and the electrical power connectors of the independently operated electrical devices enter through notches in the wall of the securable panel; the securable panel may be designed to prevent reverse passage of the electrical power connector therethrough. The receptacle is electrically connected to the electrical apparatus switch and power plug plate which make the direct connection to the power source.

A locking device, operated by the manual setting of indiced disks to a predetermined setting, is provided on a front panel of the housing. Once the indiced disks are set for operation in the predetermined setting, the adjacent handle can slide to perform two individual functions. Moving the handle in one direction will permit the changing of the predetermined setting on the indiced disks to another value. Moving the handle in the other direction will open an enclosing lid on a front panel of the housing. Once the enclosing lid is opened, three sets of objects are exposed. The enclosed attachment screw allows the authorized user to install or remove the electrical apparatus from a wall outlet. The enclosed pair of spring-loaded restraining pins allow the removal of the securable panel that prevents reverse passage of the electrical power connectors attached to the electrical apparatus' receptacle. This operation is performed by depressing both spring-loaded restraining pins simultaneously while pulling the securable panel in the direction away from the electrical apparatus' receptacle. The third device exposed is an electrical switch. One side of the switch allows current to flow from the power source through the electrical apparatus to the independently operated electrical devices. Depressing the other side of the switch stops the flow of current from the power source through the electrical apparatus to the independently operated electrical devices. In the preferred embodiment of this invention, only the side of the switch which stops the flow of current can be depressed through a membrane in the enclosing lid when the enclosing lid is in the closed position.

BRIEF DESCRIPTION OF THE DRAWINGS

Additional objects and advantages of the invention will become apparent in the course of the following specification when taken in connection with the accompanying drawings in which.

Figure 1:
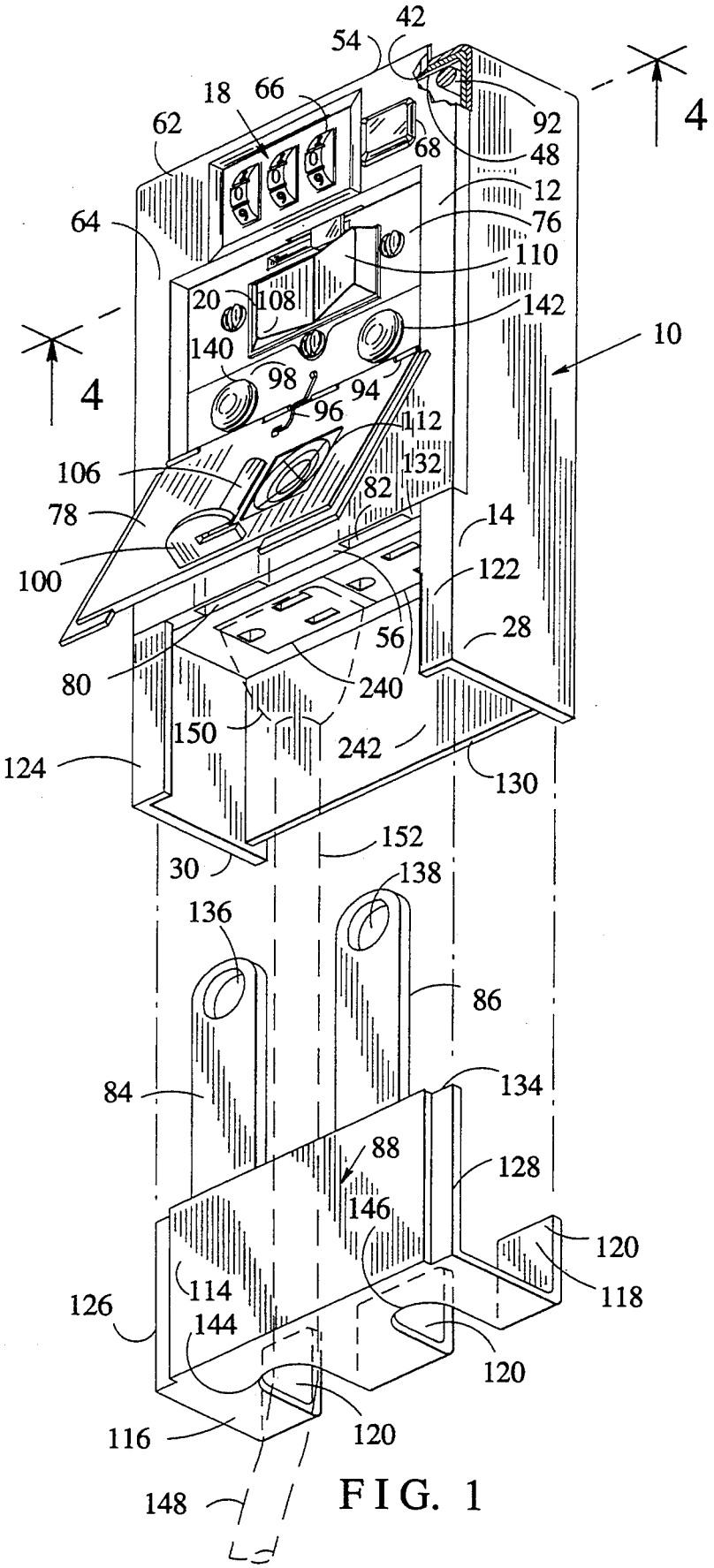
FIG. 1 is a perspective view of the apparatus for controlling use of electrically powered equipment made in accordance with the present invention with corner of upper housing broken away to show an attachment post 92; a securable enclosure 88 of the electrical apparatus shown removed from the electrical apparatus; and, an enclosing lid 78 in the open position.

| Reference Numerals in Drawings | |
|---|---|
| 10 apparatus for controlling use of electrically powered equipment (electrical apparatus) | |
| 12 upper housing (enclosure) | |
| 14 lower housing (enclosure) | |
| 16 electrical connector receptacle (receptacle) | |
| 18 locking device | |
| 20 electrical switch (switch) | 22 bottom panel (panel) |
| 24 bottom panel end (end) | 26 side wall |
| 28 side wall | 30 side wall |
| 32 side wall | |
| 34 lower side wall upper edge (upper edge) | |
| 36 lower side wall upper edge (upper edge) | |
| 38 lower side wall upper edge (upper edge) | |
| 40 side wall step (step portion) | 42 upper wall lip (lip) |
| 44 upper side wall lower edge (lower edge) | |
| 46 upper side wall lower edge (lower edge) | |
| 48 upper side wall lower edge (lower edge) | |
| 50 upper side wall | 52 upper side wall |
| 54 upper side wall | 56 upper side wall |
| 58 upper panel end (end portion) | |
| 60 upper panel end (end portion) | |
| 62 upper panel end (end portion) | 64 upper panel (panel) |
| 66 indiced disk | 68 sliding handle (handle) |
| 70 sliding bracket assenbly (assembly) | 72 rivet |
| 74 hole | 76 recessed area (area) |
| 78 enclosing lid (lid) | 80 upper housing slot (slot) |
| 82 upper housing slot (slot) | 84 securable enclosure tab (tab) |
| 86 securable enclosure tab (tab) | 88 securable enclosure |
| 90 screw | 92 attachment post |
| 94 hinge | 96 wound spring |
| 98 pin restraining plate (plate) | 100 notched tab |
| 102 support plate slot | 104 lock operator |
| 106 lid divider | 108 power-on switch side |
| 110 power-off switch side | 112 flexible membrane |
| 114 top panel (panel) | 116 front panel (panel) |
| 118 bottom panel (panel) | |
| 120 notched tab | |
| 122 securable enclosure guide | |
| 124 securable enclosure guide | |
| 126 securable enclosure edge | |
| 128 securable enclosure edge | 130 lower base edge |
| 132 upper panel edge | |
| 134 securable enclosure edge | 136 tab interface hole (hole) |
| 138 tab interface hole (hole) | 140 restraining pin (pin) |
| 142 restraining pin (pin) | 144 retaining notch |
| 146 retaining notch | 148 electrical power cable |
| 150 electrical power connector | |
| 152 end of electrical power cable (end) | |
| 154 switch support plate (plate) | 156 screw |
| 158 vertical support | 160 attachment screw |
| 162 attachment screw sleeve | 164 lockwasher |
| 166 support rod | 168 helical spring |
| 170 restraining pin lip | |
| 172 power plug plate (plate) | 174 formed rivet |
| 176 plug power blade (blade) | |
| 178 plug neutral blade (blade) | |
| 180 plug ground blade (blade) | 182 grommet |
| 184 power lead | |
| 186 power switch lead | |
| 188 receptacle power screw | 190 neutral lead |
| 192 receptacle neutral screw | 194 ground lead |

-continued

| Reference Numerals in Drawings | |
|---|---|
| 196 receptacle ground screw | 198 disk housing |
| 200 fixture support | |
| 202 fixture support | 204 upper panel slot |
| 206 bracket tab (tab) | |
| 208 shaft support plate (support plate) | 210 bracket tab (tab) |
| 212 angled shaft plate | 214 notched shaft |
| 216 disk guide plate | |
| 218 helical compressed spring | |
| 220 interlocking outer shaft (outer shaft) | 222 outer shaft tab |
| 224 unnotched section (position) | |
| 226 indiced disk tabs (disk tabs) | |
| 228 notched shaft position (position) | |
| 230 spring detent blade (blade) | 232 notches |
| 234 power cable | 236 power connector |
| 238 hole | 240 plug outlet |
| 242 electrical power connector compartment | |

DETAILED DESCRIPTION OF THE INVENTION

With reference to the drawings, there is shown in FIGS. 1, 2, 3, 4, and 7 an apparatus for controlling use of electrically powered equipment or electrical apparatus 10, in accordance with the present invention, comprising of an upper housing or enclosure 12, a lower housing or enclosure 14, in which a suitable, well-known electrical connector receptacle or outlet 16, a locking device 18, and a suitable, well-known electrical switch 20 are mounted. The receptacle 16 is of conventional type, and contains at least one plug outlet or plug receiving aperture 240, two being shown in the drawings.

Enclosure 14 comprises a bottom panel 22 with a plurality of ends 24 of which there are integrally formed side walls 26, 28, 30, 32. Upper edges 34, 36, 38 of side walls 26, 28, 30 include a step portion 40. Step portions 40 each accept a lip 42 which is formed on lower edge 44, 46, 48 of upper side walls 50, 52, 54 which are integrally formed on end portions 58, 60, 62 of an upper panel 64 of enclosure 12. Note that neither side wall 32 nor upper side wall 56 include the aforementioned step portion/lip combination in the current embodiment, A plurality of indiced disks 66 and a sliding handle or button 68 partly project beyond enclosure 12 so they may be manually operated. Handle 68 is attached to a sliding bracket assembly 70 by a rivet or fastener 72 after being inserted through a hole 74 of assembly 70. A recessed area 76 is exposed when an enclosing lid or panel 78 is in the open position. Lid 78 is sized such that area 76 as well as its contents cannot be accessed when lid 78 is in the closed position. Enclosure 12 also includes a set of upper housing slots or sleeves 80, 82 sized and positioned to allow a set of securable enclosure tabs or blades 84, 86 to project through slots 80, 82. Securable enclosure tabs 84, 86 are attached to a securable enclosure or device 88 which will be described presently.

Figure 2:
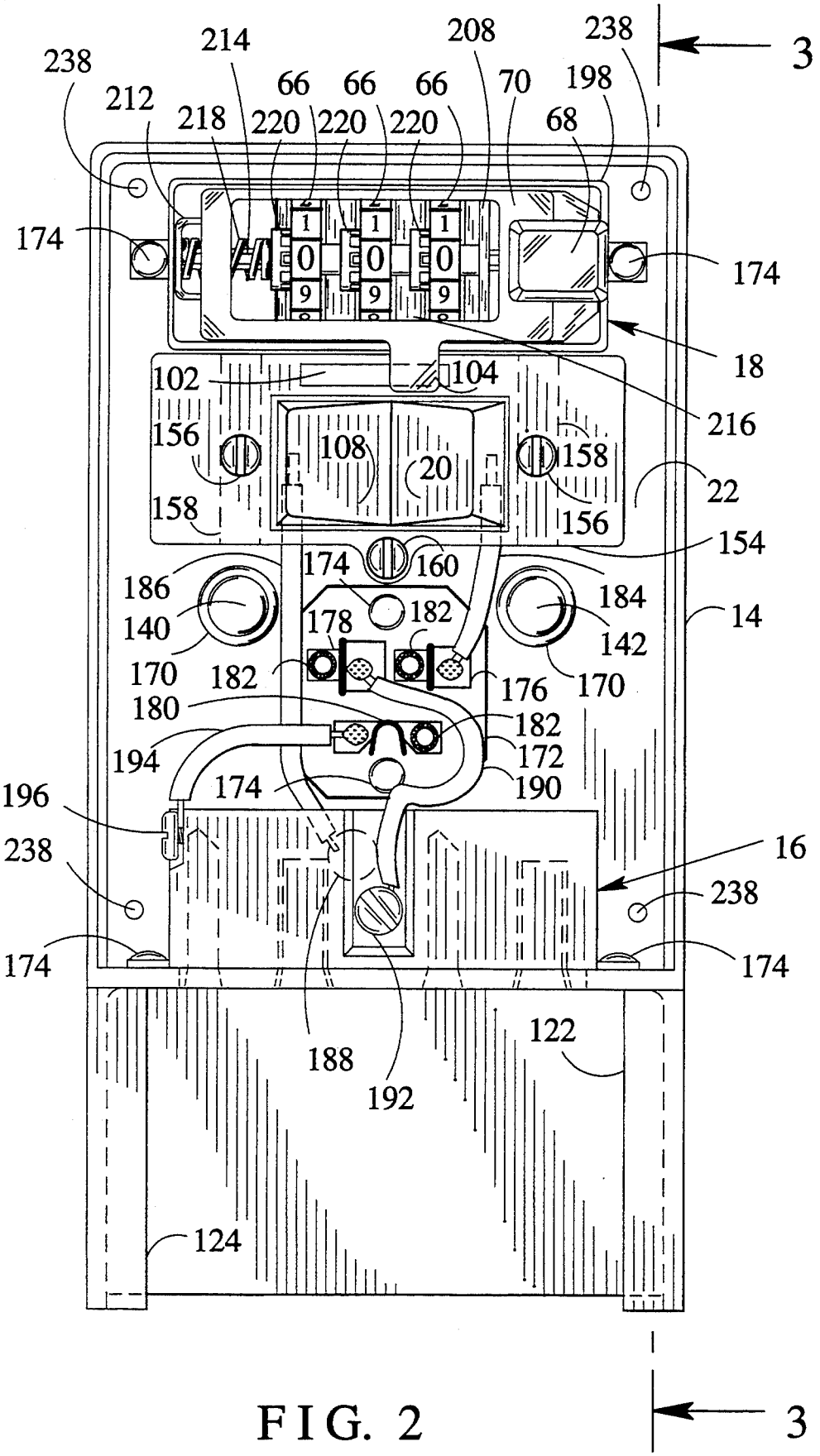
FIG. 2 is a view of the apparatus for controlling use of electrically powered equipment made in accordance with the present invention with an upper housing 12 and securable enclosure 88 shown removed from the electrical apparatus and a sliding handle 68 shown attached to a sliding bracket assembly 70.
Figure 4:
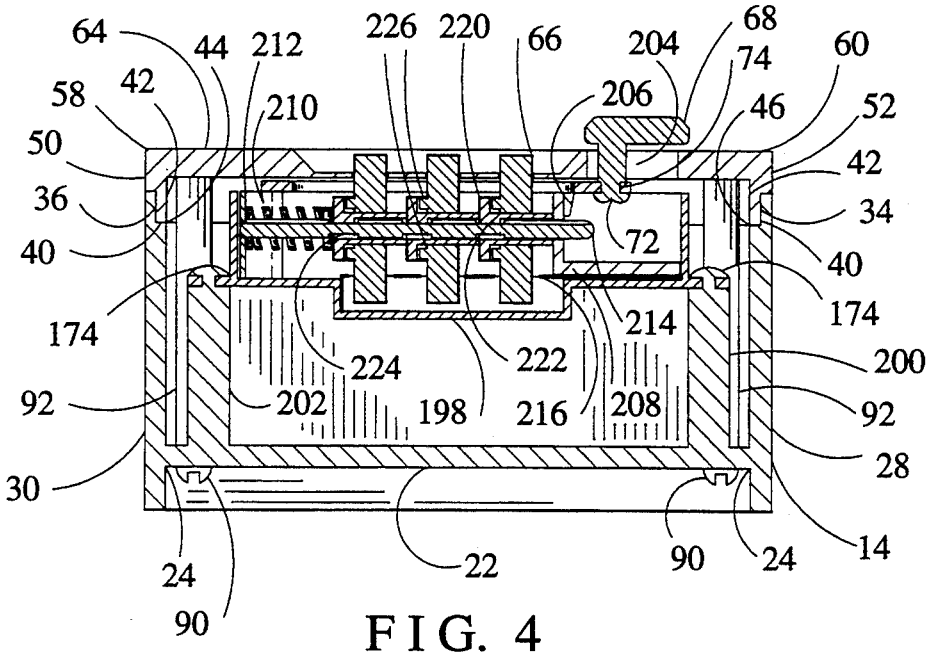
FIG. 4 is a cross-sectional view taken along the line 4—4 of FIG. 1.

As is best shown in FIGS. 1, 2, and 4, enclosure 12 is connected to bottom panel 22 of enclosure 14 by means of a plurality of screws or fasteners 90 which extend through a set of holes 238 to engage a plurality of attachment posts or columns 92 which are integrally formed to the bottom of enclosure 12. FIG. 1 shows lid 78 attached to upper panel 64 by a hinge 94. A wound spring 96, attached to hinge 94 and pushing against lid 78 and a pin restraining plate 98 holds lid 78 open. When lid 78 is in the closed position, a notched tab 100 projects through a support plate slot or cutout 102 and is engaged by a lock operator 104 as shown in FIG. 2, preventing wound spring 96 from pushing open lid 78. When lid 78 is in the closed position, a lid divider 106 bisects the face of electrical switch 20 to prevent a user from depressing a power-on switch side 108 through a flexible membrane 112 located over a power-off switch side 110.

In FIG. 1, securable enclosure 88 has been shown removed from electrical apparatus 10. Securable enclosure 88 is used to restrict access to electrical power connectors 150 located in an electrical power connector compartment 242. Securable enclosure 88 includes a top panel 114, a front panel 116, and a bottom panel 118 which consists of a plurality of notched tabs or elements 120. Top panel 114 includes two securable enclosure tabs 84, 86 which project under the top wall of panel 64 through slots 80, 82. The dimensions of panels 114, 116 are chosen such that securable enclosure 88 contacts the lower surface of a set of securable enclosure guides 122, 124, securable enclosure edges 126, 128 contact the inside of side walls 30, 28 and bottom panel 118 contacts the bottom of panel 22 when securable enclosure 88 is in the closed position. The inside of panel 116 will be flush with the face of a lower base edge 130. With securable enclosure 88 in the closed position, an upper panel edge 132 will contact a securable enclosure edge 134 and a set of tab interface holes or cutouts 136, 138 will be aligned over a set of restraining pins or columns 140, 142 such that the tops of pins 140, 142 protrude through holes 136, 138 and prevent removal of securable enclosure 88.

Panels 116, 118 of securable enclosure 88 include a set of two retaining notches or slots 144, 146 which are large enough to admit a set of electrical power cables or cords like 148. The number of notches provided is equal to the number of outlets provided for in receptacle 16 with each notch aligned with an outlet. When securable enclosure 88 is attached to electrical apparatus 10, each retaining notch 144, 146 shown is only wide enough to accommodate the width of an ordinary end 152 of an electrical power cable 148 thereby preventing the passage of an electrical power connector 150 through the notch.

Figure 3:
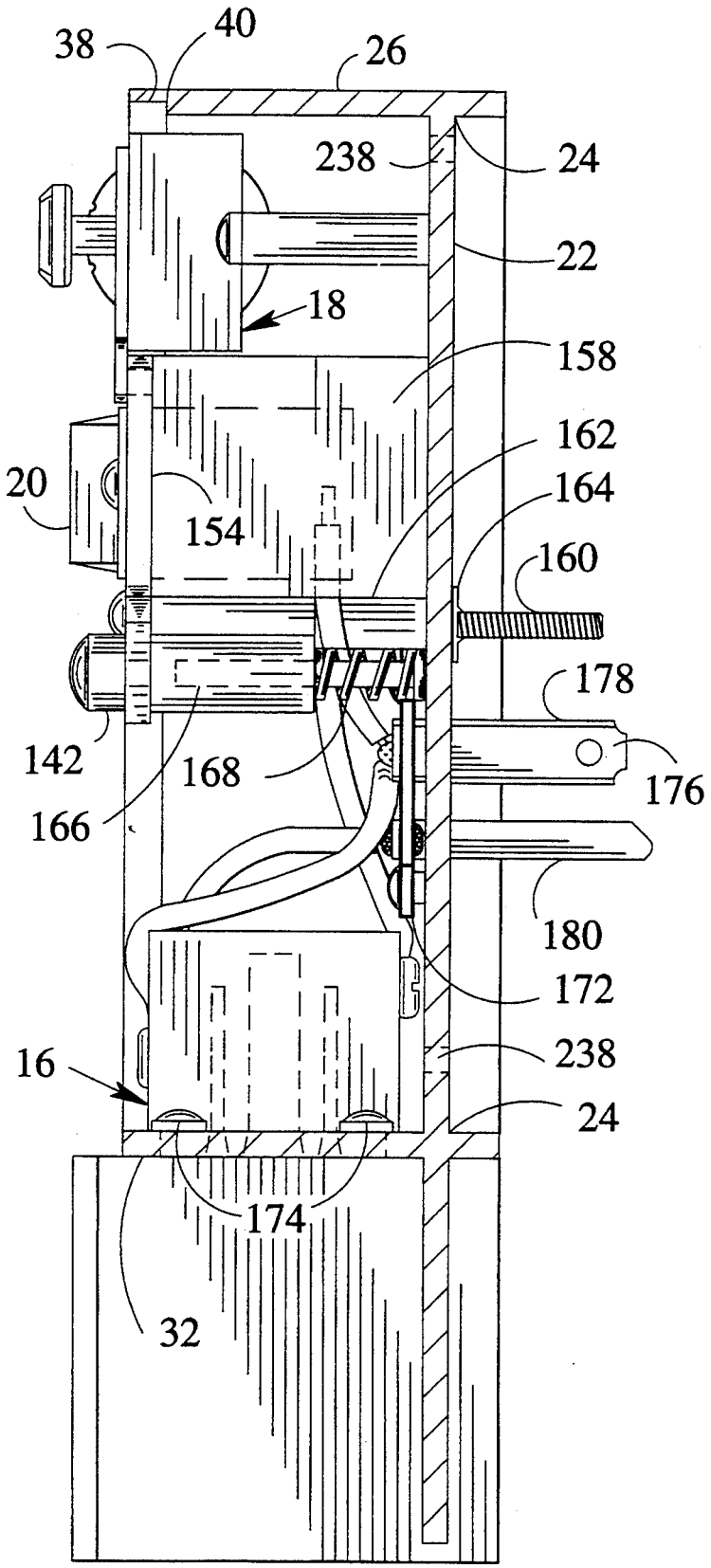
FIG. 3 is a cross-sectional view taken along the line 3—3 of FIG. 2.

FIG. 2 shows switch 20 attached to a switch support plate 154 which is attached by a plurality of screws or fasteners 156 to a plurality of vertical supports 158 that are integrally connected to panel 22. As shown in FIG. 3, an attachment screw or fastener 160 projects through plate 154 and an attachment screw sleeve or housing 162 that is integrally connected to panel 22. Attachment screw 160, which is prevented from sliding out by a lockwasher 164, can be secured to a wall receptacle which is well known and not shown.

FIGS. 1, 2, and 3 show pin 142 positioned over a support rod or column 166 that is integrally connected to panel 22. A helical spring 168 is compressed when enclosures 12, 14 are joined, causing plate 98 to apply pressure on a restraining pin lip or edge 170. Plate 98 is an integral part of panel 64. The top of pin 142 is high enough to restrict the movement of securable enclosure tab 86 unless downward pressure is applied to pin 142 with sufficient force to position it below the bottom of securable enclosure tab 86. As is shown in FIG. 2, pin 142 is one of two pins 140, 142 which both operate in the manner which has just been described.

FIGS. 2 and 3 show a power plug plate or device 172 attached to panel 22 by a plurality of formed rivets or fasteners 174 whose manufacturing process is well-known. As shown in FIGS. 2 and 3, a plurality of formed rivets 174 are also used to attach receptacle 16 to side wall 32 and locking device 18 to a set of fixture supports or columns 200, 202.

FIGS. 2 and 3 show plate 172 provides for the attachment of a plug power blade or lead 176, a plug neutral blade or lead 178, and a plug ground blade or lead 180 by means of a plurality of grommets or fasteners 182. Blades 176, 178, 180 extend through panel 22 so they may be connected to a source of power. Electrical current flows from blade 176 to switch 20 by means of a power lead or wire 184. Depressing power-on switch side 108 allows electrical current to flow through switch 20 into receptacle 16 by means of a power switch lead or wire 186 which is attached to receptacle 16 at a receptacle power screw or fastener 188. Blade 178 is connected to receptacle 16 by means of a neutral lead or wire 190 which is attached to receptacle 16 at a receptacle neutral screw or fastener 192. Blade 180 is attached to receptacle 16 by means of a ground lead or wire 194 which is affixed to receptacle 16 at a receptacle ground screw or fastener 196. The flow of current through the elements described above is possible only when electrical apparatus 10 is connected to a source of electrical power.

FIGS. 1, 2, 4, and 5 show locking device 18 whose main function is to keep lid 78 in the closed position. As presently preferred, locking device 18 is adapted to enclose all its mechanisms within a disk housing or enclosure 198 which is attached by a plurality of formed rivets or fasteners 174 to fixture supports 200, 202 which are integrally connected to panel 22. Handle 68 is permanently attached to assembly 70 by rivet 72 after being placed through an upper panel slot or cutout 204. FIG. 4 shows handle 68 in its installed position. Assembly 70 is aligned such that a plurality of integrally formed bracket tabs 206 contact the right side of a shaft support plate or bracket 208 and a plurality of bracket tabs 210 contact the left side of an angled shaft plate 212. Assembly 70 rests on the upper edges of support plate 208 and angled shaft plate 212.

Figure 5:
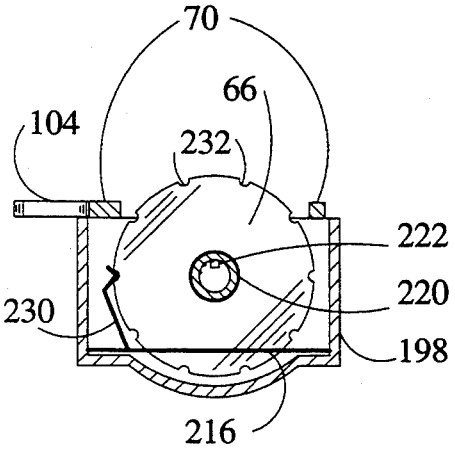
FIG. 5 is a diagrammatical detail view of a complete indiced disk 66 and a disk housing 198 with a notched shaft 214 removed for clarity.

Within disk housing 198 is a notched shaft 214 which is fixedly attached to angled shaft plate 212 on one end and freely supported by support plate 208 on the other end. Notched shaft 214 is clearly shown in FIG. 6. As shown in FIGS. 2, 4, and 5, a disk guide plate 216 underneath support plate 208 keeps indiced disks 66 from moving to the left or right. A helical compressed spring 218 normally urges a plurality of interlocking outer shafts or sleeves 220 together, with the rightmost outer shaft 220 end pressed against support plate 208.

Figure 6:
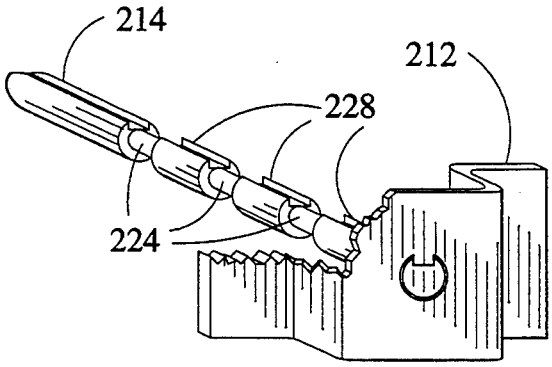
FIG. 6 is a perspective view of notched shaft 214 with a portion of angled shaft plate 212 broken away to expose a set of unnotched sections 224 and a set of notched shaft positions 228; and, FIG. 7 is an alternate embodiment of the apparatus for controlling use of electrically powered equipment with a power cable 234 and a power connector 236 in place of the assembly including a power plug plate 172, a plug power blade 176, a plug neutral blade 178, and a plug ground blade 180, not shown.

Indiced disks 66 and outer shafts 220 are free to rotate about notched shaft 214 when their outer shaft tabs 222 are located at unnotched sections 224 as shown in FIGS. 4, 5, and 6. A set of indiced disk tabs 226 prevent indiced disks 66 and outer shafts 220 from rotating separately at unnotched sections 224. When outer shaft tabs 222 are aligned with the notch in notched shaft 214, outer shafts 220 are free to move left or right. Motion will occur only when all outer shafts 220 are aligned as described above and a force is applied to handle 68 in the proper direction. Under the aforementioned conditions, applying a force to the left on handle 68 will cause tabs 206 to apply a force to support plate 208, resulting in outer shaft tabs 222 moving to a set of notched shaft positions 228. Indiced disks 66 are kept in their original position by disk guide plate 216 and are free to rotate because disk tabs 226 are not engaging outer shafts 220. Outer shafts 220 cannot rotate at positions 228 because outer shaft tabs 222 are engaging the notch of notched shaft 214. All outer shafts 220 and indiced disks 66 will act in a manner identical to that described above should handle 68 be moved to the left.

With initial conditions described above, applying a force to the right on handle 68 will cause tabs 210 to apply a force to angled shaft plate 212, resulting in angled shaft plate 212 and notched shaft 214 moving to the right. This results in outer shaft tabs 222 aligning themselves over positions 228. With this alignment, outer shafts 220 cannot rotate because outer shaft tabs 222 are engaging the notch of notched shaft 214. Additionally, indiced disks 66 are held in their original positions by disk guide plate 216 and cannot rotate because disk tabs 226 continue to engage outer shafts 220. All outer shafts 220 and indiced disks 66 will act in a manner identical to that described above should handle 68 be moved to the right. This action of applying a force to the right on handle 68 will also result in lock operator 104 moving to the right. Lock operator 104 is an integral part of sliding bracket assembly 70.

FIG. 5 shows indiced disk 66 without notched shaft 214 for clarity. Indiced disks 66 are marked with numbers. Other symbols such as letters could also be used. Between the numbers are a set of notches or indentations 232 adapted to be engaged by the free end of a spring detent blade 230 to hold the disk in set position. Blade 230 is an integral part of disk guide plate 216. The indiced disk 66 of course can be manually rotated to any predetermined setting provided all outer shaft tabs 222 are in positions 224. The plurality of indiced disks 66 are all arranged as described above.

In FIGS. 1, 2, and 4 only three indiced disks and outer shafts are shown. It is quite obvious of course that the number of disks is a matter of choice and therefore these illustrations are by no means intended to limit the electrical apparatus 10 to a three-disk arrangement.

Figure 7:
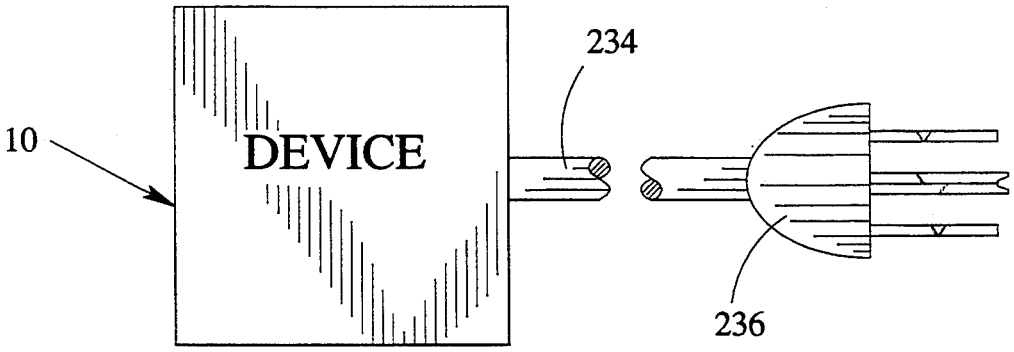

FIG. 7 is an alternate embodiment of the electrical apparatus 10 with a power cable 234 and power connector 236 in place of the assembly including power plug plate 172, blades 176, 178, and 180, not shown in this figure. Power connector 236 is adapted to be inserted into a conventional electrical outlet, not shown. Electrical apparatus 10 would be reconfigured to accommodate the direct connection of power lead 184, neutral lead 190, and ground lead 194 to their separate components in power cable 234, not shown. Attachment screw 160 would not be required in this alternate embodiment.

DETAILED OPERATION OF THE INVENTION—FIGS. 1, 2, 3, 4

In use, after the correct combination has been selected on locking device 18 by using indiced disks 66, handle 68 may be placed in either of two positions, the combination set position or the release position for lid 78. In the current embodiment, the setting on locking device 18 must be changed in order to deny unauthorized users the ability to move handle 68 to the aforementioned positions.

The combination set position is acquired by moving handle 68 to the left in the current embodiment after the correct combination has been selected in locking device 18. Holding handle 68 in this position, the user may select a new combination for electrical apparatus 10 by rotating indiced disks 66 to a new setting. Releasing handle 68 will cause handle 68 to return to its original position with the new combination set in locking device 18. The user may now change the displayed value on locking device 18 to any position by rotating indiced disks 66, preventing the movement of handle 68 by unauthorized users.

The release position for lid 78 is acquired by moving handle 68 to the right in the current embodiment after the correct combination has been selected in locking device 18. Moving handle 68 to the right causes sliding bracket assembly 70 as well as lock operator 104 to move to the right. This action results in lock operator 104 clearing the slot in notched tab 100, allowing wound spring 96 to urge lid 78 open. With lid 78 in the open position, recessed area 76 is visible with attachment screw 160, pins 140, 142 and switch 20 exposed at a minimum. Attachment screw 160 is used to secure electrical apparatus 10 to a standard wall outlet by means of the center screw hole of same wall outlet, not shown. The use of attachment screw 160 denies removal of electrical apparatus 10 from a wall outlet because it cannot be accessed when lid 78 is in the closed position. Inserting blades 176, 178, 180 into a powered wall outlet provides electrical current to electrical apparatus 10. In an alternate embodiment shown in FIG. 7, blades 176, 178, 180 are replaced by power cable 234 and power connector 236. Affixing power connector 236 to a powered wall outlet provides electrical current to electrical apparatus 10 in this alternate embodiment.

Simultaneously depressing pins 140, 142 disengages securable enclosure tabs 84, 86 from pins 140, 142, allowing a user to remove securable enclosure 88, exposing receptacle 16. With securable enclosure 88 removed the user can insert or remove electrical power connectors 150 from receptacle 16. The electrical power cables 148 attached to aforementioned electrical power connectors 150 can be routed through retaining notches 144, 146 to prevent interference with the closure of securable enclosure 88. Securable enclosure 88 is designed such that electrical power connectors 150 inserted in receptacle 16 can only be removed when securable enclosure 88 is removed from electrical apparatus 10. To close securable enclosure 88, the user aligns securable enclosure tabs 84, 86 with slots 80, 82 and exerts a forward motion on securable enclosure 88, projecting tabs 84, 86 under the top wall of panel 64 through slots 80, 82. Securable enclosure 88 will be held in the closed position after pins 140, 142 engage holes 136, 138.

Once electrical apparatus 10 is affixed to a powered wall outlet, depressing power-on switch side 108 allows electrical current to flow through switch 20 to receptacle 16 in the present embodiment. This action results in connecting devices attached to receptacle 16 to the source of electrical power. Lid 78 is designed such that power-on switch side 108 cannot be depressed when lid 78 is in the closed position. Depressing power-off switch side 110 stops the flow of electrical current from the power source to devices attached to receptacle 16. Power-off switch side 110 can be depressed directly with lid 78 in the open position or through flexible membrane 112 when lid 78 is in the closed position. The second method mentioned for depressing power-off switch side 110 is provided for safety and convenience reasons in the present embodiment.

SUMMARY, RAMIFICATIONS, AND SCOPE

Thus the reader will see that the apparatus for controlling use of electrically powered equipment described herein provides a simple lockable electrical apparatus to limit the operation of electrical equipment to authorized users. The electrical apparatus also prevents unauthorized users from removing electrical power connectors attached to the receptacles of the electrical apparatus and emphasizes safety and ease of manufacture in its design.

While a preferred embodiment of the invention has been shown and described herein, it is obvious that numerous additions, changes, and omissions may be made in such embodiments without departing from the spirit and scope of the invention. For example, The shape may be modified to reduce material costs provided that the electrical switch that allows the flow of power to the attached electrical appliances is protected from unauthorized users in some way.

Simpler approaches are also available to reduce manufacturing costs—make the locking device nonprogrammable; delete the securable enclosure that restricts removal of electrical power connectors from the electrical apparatus; use the locking device to unlock a single enclosing lid that reveals the electrical switch and allows the removal of electrical power connectors when in the open position; change from wall-mounted to a box with an extension cable as depicted in FIG. 7, etc.

Integrate the electrical apparatus with the wall outlet as opposed to an add-on unit as described above.

Reconfigure the electrical apparatus to be a part of a power strip with a multitude of receptacles.

Reconfigure the electrical apparatus to include one or all of the following: circuit breakers, ground fault interruption hardware, electrical surge protection.

Employ a digital keypad, computerized lock, or different form of mechanical lock to regulate the unlocking of the enclosing lid.

Install the locking device on a remote control device that regulates the flow of current to the invention's receptacle.

Use the locking and lid portions of the electrical apparatus to deny access or operability of objects or equipment such as a light switch, phone touchpad, water valve, or other regulating device that is located behind the enclosing lid.

The locking device and enclosing lid concept may be applied on industrial machinery, farm equipment, or other antitheft or alarm systems in which the mechanism of the electrical apparatus would be protected by a heavy or impenetrable material. Since the locking device and enclosing lid are operated manually they could be used in any of the above applications without fear of electrical malfunction.

Accordingly, the scope of the invention should be determined not by the embodiments illustrated, but by the appended claims and their legal equivalents.

Total Possible Combinations of the Locking Device 18:

999 (may be altered by adding or deleting indiced disks as desired).

I claim:

1. An electrical apparatus for at least one electrically operated device having an electrical power cable and an electrical power connector for connecting said electrical power cable to a source of electrical power comprising, an electrical connector receptacle means capable of receiving said electrical power connector, a power plug means connected to said electrical connector receptacle means providing said electrical connector receptacle means with an electrical circuit connection between said source of electrical power and said electrical connector receptacle means, an electrical switch means capable of energizing and de-energizing said electrical connector receptacle means, an enclosing means which denies access to said switch means when said enclosing means is in a closed position, a locking means capable of a first position in which said enclosing means may be opened, allowing access to said switch means and a second position engaging said enclosing means to deny access to said switch means, said locking means comprising a lock operating means capable of engaging said enclosing means, whereby said switch means is operated by a user of said electrical apparatus when said enclosing means is opened and said locking means does not act to actuate said switch means.

2. The electrical apparatus according to claim 1, wherein said locking means is comprised of at least one indiced disk having positions for a plurality of settings and a corresponding manually operable rotating means, each of said manually operable rotating means being adapted to enter any setting displayable on a corresponding one of said at least one indiced disk, with the movement of said lock operating means being regulated by at least one element adapted for engagement by said lock operating means and said at least one indiced disk whereby the user can open said enclosing means after entering a correct setting on said at least one indiced disk.

3. The electrical apparatus according to claim 2, wherein said at least one element is adapted to allow free operation of said lock operating means with a new setting on said at least one indiced disk by rotating said at least one indiced disk to the current setting which allows free Operation of said lock operating means and selecting a new setting while said at least one element is engaged by translating said lock operating means, whereby a user can reprogram the setting allowing free operation of said locking means to a new value.

4. The electrical apparatus according to claim 1, further including an attachment means to prevent removal of said electrical apparatus from said source of electrical power,

5. The electrical apparatus according to claim 4, wherein said enclosing means denies access to said attachment means when said enclosing means is in the closed position.

6. The electrical apparatus according to claim 1, in which said enclosing means further allows the user to de-energize said switch means while said enclosing means is in the closed position.

7. The electrical apparatus according to claim 1, wherein said power plug means is a power cable, said power cable terminating in a power connector which is adapted to be inserted into a conventional electrical outlet.

8. The electrical apparatus according to claim 1 further comprising, a securable enclosing means capable of a first position providing access to said electrical connector receptacle means, allowing the attachment of said electrical power connector to said electrical connector receptacle means, and a second position denying access to said electrical connector receptacle means, a restraining means capable of a first position allowing said securable enclosing means to be moved to a position allowing access to said electrical connector receptacle means and a second position engaging said securable enclosing means, preventing tile movement of said securable enclosing means to a position allowing access to said electrical connector receptacle means.

9. The electrical apparatus according to claim 8, wherein said enclosing means denies access to said restraining means when said enclosing means is in the closed position.

10. The electrical apparatus according to claim 8, further including an attachment means to prevent removal of said electrical apparatus from said source of electrical power.

11. The electrical apparatus according to claim 8, in which said enclosing means further allows the user to de-energize said switch means while said enclosing means is in the closed position.

12. The electrical apparatus according to claim 8, further comprising a retaining means for retaining said electrical power connector of said at least one electrically operated device within said securable enclosing means, wherein said retaining means comprises at least one notch portion with said at least one notch portion proportioned of a size to accept said power cable and permit passage of said power cable while preventing passage of said electrical power connector through said at least one notch portion when said securable enclosing means is positioned to deny access to said electrical connector receptacle means, thereby retaining said electrical power connector within said securable enclosing means.

13. The electrical apparatus according to claim 8, wherein said power plug means is a power cable, said power cable terminating in a power connector which is adapted to be inserted into a conventional electrical outlet.

14. An electrical apparatus according to claim 8, further comprising a housing means having a plurality of wall portions wherein said securable enclosing means, normally mounted on said housing means, includes at least one projecting portion and in which said housing means includes at least one recessed portion with said at least one projecting portion retained by said at least one recessed portion when said securable enclosing means is mounted on said housing means.

15. An electrical apparatus for at least one electrically operated device having an electrical power connector for connecting said electrically operated device to a source of electrical power comprising, a housing means having a plurality of wall portions, an electrical connector receptacle means mounted in said housing means adapted to receive said electrical power connector therein for completing an electrical circuit connection therebetween, a power plug means connected to said electrical connector receptacle means providing said electrical connector receptacle means with an electrical circuit connection between said source of electrical power and said electrical connector receptacle means, an electrical switch means mounted in said housing means, capable of regulating tile electrical circuit between said power plug means and said electrical connector receptacle means, said switch means controlling whether said electrical connector receptacle means is energized or de-energized, an enclosing means mounted on said housing means which denies access to said switch means when said enclosing means is in a closed position and allows access to said switch means when said enclosing means is in an open position, a locking means mounted on said housing means and capable of engaging said enclosing means to restrict said enclosing means to the closed position, whereby said switch means is operated by a user of said electrical apparatus when said enclosing means is opened and said locking means does not act to actuate said switch means.

16. In an apparatus for controlling use of electrically powered equipment, said electrical apparatus preventing unauthorized supply of electrical energy to at least one electrical power connector for an electrical power cable of an electrically operated device comprising, an electrical connector receptacle means adapted to receive said electrical power connector to be energized therefrom, a securable enclosing means capable of a first position providing access to said electrical connector receptacle means, allowing the attachment of said electrical power connector to said electrical connector receptacle means, and a second position denying access to said electrical connector receptacle means, a restraining means capable of a first position allowing said securable enclosing means to be moved to a position allowing access to said electrical connector receptacle means and a second position engaging said securable enclosing means, preventing movement of said securable enclosing means to a position allowing access to said electrical connector receptacle means, an electrical switch means capable of energizing and de-energizing said electrical connector receptacle means, an enclosing means which denies access to said switch means and said restraining means when said enclosing means is in closed position, a locking means capable of a first position in which said enclosing means may be opened, allowing access to said switch means and said restraining means and a second position engaging said enclosing means to deny access to said switch means and said restraining means, said locking means comprised of at least one indiced disk having positions for a plurality of settings and a corresponding manually operable rotating means, each of said manually operable rotating means being adapted to enter any setting displayable on a corresponding one of said at least one indiced disk, engagement of said locking means with said enclosing means being regulated by at least one element adapted for engagement by said enclosing means and said at least one indiced disk whereby a user can open said enclosing means after entering a correct setting on said at least one indiced disk, thereby limiting operation of said at least one electrically operated device to persons capable of gaining access to said switch means.

* * * * *